US006830464B1

(12) United States Patent
Friend

(10) Patent No.: US 6,830,464 B1
(45) Date of Patent: Dec. 14, 2004

(54) METHODS AND APPARATUS FOR HOLDING A MODULE TO A CONNECTOR

(75) Inventor: Steven Darren Friend, Cupertino, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 10/208,541

(22) Filed: Jul. 30, 2002

(51) Int. Cl.[7] ..... H01R 12/00
(52) U.S. Cl. ..... 439/74
(58) Field of Search ..... 439/74, 342, 259, 439/260, 270

(56) References Cited

U.S. PATENT DOCUMENTS 5,002,499 A * 3/1991 Matsuoka ..... 439/342
5,011,426 A 4/1991 Colleran et al. ..... 439/357
5,389,000 A 2/1995 DiViesti et al. ..... 439/157
6,142,787 A 11/2000 Ikesugi ..... 439/15
6,181,559 B1 * 1/2001 Seo ..... 361/704
6,193,563 B1 2/2001 Yagi et al. ..... 439/701
6,371,788 B1 4/2002 Bowling et al. ..... 439/358
6,485,320 B1 * 11/2002 Ma ..... 439/342

* cited by examiner

*Primary Examiner*—J. Duverne
(74) *Attorney, Agent, or Firm*—Chapin & Huang, LLC; David E. Huang, Esq.

(57) ABSTRACT

A technique connects a module to a connector. The technique involves inserting the module into a connector base of the connector, and moving a first connector lever of the connector against the module and a second connector lever of the connector against the module. The technique further involves installing a clip onto the connector such that the clip provides a first force on the first connector lever and a second force on the second connector lever to hold the module to the connector. The presence of the clip prevents the connector levers from moving away from the module (e.g., separating from the module sides) and allowing the module to escape from the connector.

23 Claims, 6 Drawing Sheets

METHODS AND APPARATUS FOR HOLDING A MODULE TO A CONNECTOR

BACKGROUND OF THE INVENTION

A typical circuit board includes a section of circuit board material (i.e., layers of conductive and non-conductive material sandwiched together) and a set of circuit board components (e.g., ICs, resistors, capacitors, connectors, etc.) mounted on one or more surfaces of the section of circuit board material. Some circuit boards include a module connector and a module that connects to the module connector. In some situations, the module is itself a circuit board, i.e., a section of circuit board material with circuit board components mounted thereon.

One conventional module connector includes a connecting portion that mounts to (e.g., solders to, press-fits and bolts to, etc.) a main circuit board. This connector further includes two connector levers that fasten to the connecting portion of the connector at respective hinges. Each connector lever includes a tab that aligns with a corresponding notch along a side of the module when the module connects with the module connector.

The conventional approach to installing a module within the module connector is commonly performed by a user. To install the module, the user typically (i) inserts a connecting edge of the module into the connector portion of the connector at an angle (e.g., at a 30 degree angle), and (ii) pivots the module to a lower angle (e.g., a 22.5 degree angle). The connector levers are spring loaded such that, when the module rotates downward, the connector levers deflect simultaneously past the sides of the module. As the module seats in the connector, the connector levers snap back locking the module in place. In particular, the connector levers close against the module such that the tabs of the connector levers insert into corresponding notches along the sides of the module.

At this point, the module is properly connected to the module connector, i.e., module contacts along the connecting edge of the module are now in electrical communication with corresponding connector contacts within the connecting portion of the connector. A module connector which is configured in a manner similar to the module connector described above, and which operates in a similar manner, is product number 74398-0002 manufactured by Molex, Inc. of Lisle, Ill.

SUMMARY OF THE INVENTION

Unfortunately, there are deficiencies to the above-described conventional approach to installing a module in a module connector. For example, the module can become disconnected from the module connector when exposed to certain types of shock or vibration. In particular, it is possible for the module to disconnect from the module connector during normal shipping. That is, the notched sides of the module escape the tabbed levers of the connector, and the module moves relative to the connector such that the module contacts no longer reliably connect with the connector contacts. Such disconnection can occur even if (i) the module connector and the module are installed on a main circuit board within an electronic device (e.g., a computer, a data communications device, etc.), and (ii) that electronic device passes a comprehensive shock and vibration test.

If disconnection occurs when the device ships from the device manufacturer to a customer, the customer may discover that the device does not work properly when installing the device at the customer's site, e.g., the customer might see that the device does not even pass self-test when turning on the device. Such situations may lead to additional time and costs incurred identifying and rectifying the failure (e.g., returning the device to the manufacturer for a new one, a field service call, etc.). Additionally, in some situations, the result may be lost customer goodwill and/or a lost reputation for quality.

In contrast to the above-described conventional approach to installing a module within a module connector, the invention is directed to techniques which utilize a clip that facilitates retention of a module within a connector. The clip is configured to install onto the connector and to provide force against levers of the connector to retain the module within the connector, i.e., to prevent the module from disconnecting from the connector. The use of such a clip on a circuit board assembly of a device decreases the likelihood of a device failure thus enhancing device reliability and customer goodwill.

One embodiment of the invention is directed to a method for connecting a module to a connector. The method includes the step of inserting the module into a connector base of the connector, and moving a first connector lever of the connector against the module and a second connector lever of the connector against the module. The method further includes the step of installing a clip onto the connector such that the clip provides a first force on the first connector lever and a second force on the second connector lever to hold the module to the connector. Accordingly, the presence of the clip prevents the connector levers from moving away from the module (e.g., separating from the module sides) and from allowing the module to escape from the connector.

The features of the invention, as described above, may be employed in systems, circuit board assemblies and methods, as well as other electronic components such as those of Cisco Systems, Inc. of San Jose, Calif.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The invention is directed to techniques for connecting a module to a connector utilizing a clip that facilitates retention of the module within the connector. The clip is configured to install onto the connector and to provide force against levers of the connector to retain the module within the connector, i.e., to prevent the module from disconnecting from the connector. The use of such a clip on a device to retain a module within a connector of the device decreases the likelihood of a device failure thus enhancing device reliability and customer goodwill.

Figure 1:
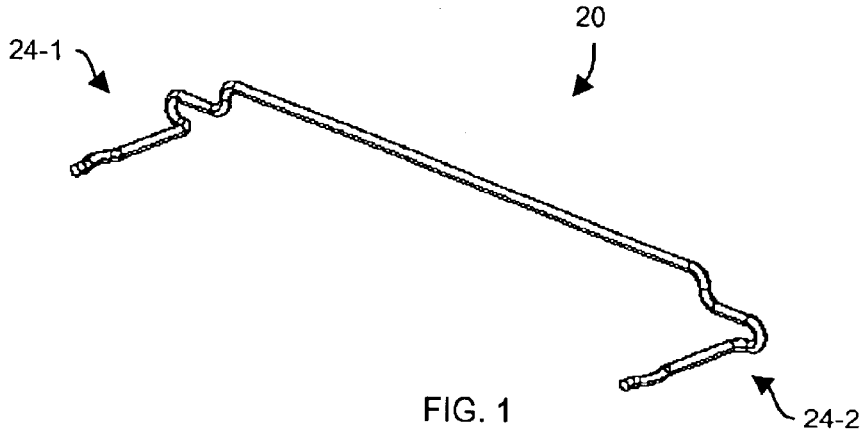
FIG. 1 is a perspective view of a clip which is suitable for use by the invention.

FIG. 1 shows a clip 20 which is suitable for use by the invention. The clip 20 is configured to hold a module to a module connector. A suitable module connector includes a connector base, and a pair of connector levers coupled to the connector base. That is, a first connector lever hinges to the connector base at a first end of the connector base, and a second connector lever hinges to the connector base at a second end of the connector base.

As shown in FIG. 1, the clip 20 includes a central portion 22, a first arm portion 24-1 coupled to the central portion 22, and a second arm portion 24-2 coupled to the central portion 22. The arm portions 24-1, 24-2 are disposed relative to the central portion 22 such that, when the module connects with the connector base of the connector and when the clip 20 is installed onto the connector, (i) the central portion 22 of the clip 20 extends in a substantially parallel manner over a surface of the module, (ii) the first arm portion 24-1 provides a first force on the first connector lever, and (iii) the second arm portion 24-2 provides a second force on the second connector lever to hold the module to the connector. Further details of the invention will now be provided with reference to FIGS. 2A and 2B.

Figure 2A:
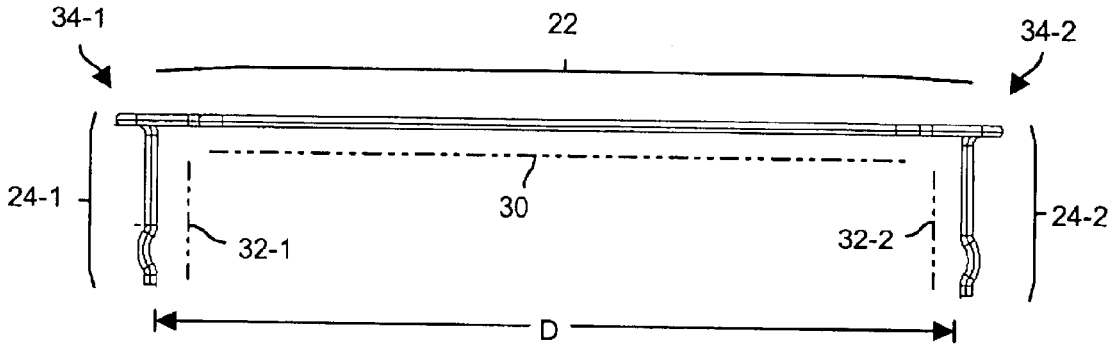
FIG. 2A is a top view of the clip of FIG. 1.
Figure 2B:
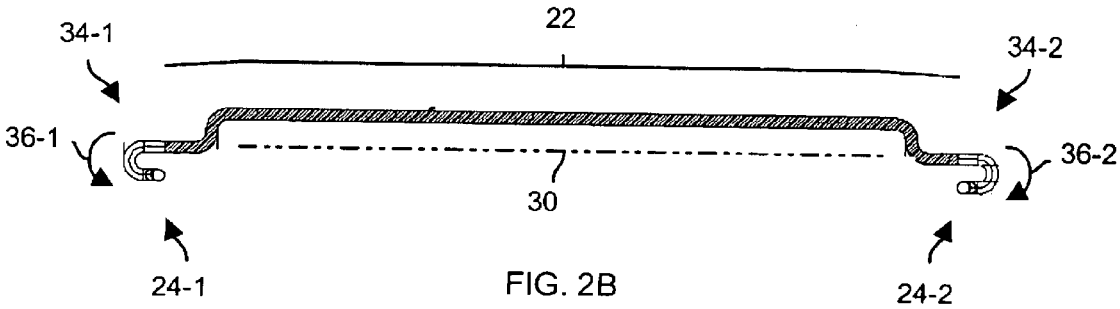
FIG. 2B is a front view of the clip of FIG. 1.

FIG. 2A shows a top view of the clip 20, and FIG. 2B shows a front view of the clip 20. As shown in FIGS. 1, 2A and 2B, the central portion 22 extends substantially in a central portion direction 30, i.e., along a central portion axis 30. The first arm portion 24-1 extends substantially in a first arm portion direction 32-1 that is substantially perpendicular to the central portion direction 30. Similarly, the second arm portion 24-2 extends substantially in a second arm portion direction 32-2 that is substantially perpendicular to the central portion direction 30. A distance D (e.g., 2.740 inches) separates the arm portion 24-1 and the arm portion 24-2 (see FIG. 2A). As will be explained in further detail later, the perpendicular arrangement of the portions 22, 24-1, 24-2 prevents the clip 20 from inadvertently pivoting out of position relative to the module connector, and/or releasing connector levers of the module connector when the clip 20 is installed over the connector to retain a module within the connector.

Additionally, as further shown in FIGS. 1, 2A and 2B and as will be discussed in further detail later, the arm portions 24-1, 24-2 respectively define loop sections 34-1, 34-2. Each loop section 34-1, 34-2 has a bend radius 36-1, 36-2 that conforms to a corresponding connector lever of the connector. Accordingly, the arm portions 24-1, 24-2 are configured to tightly fit around the connector levers for a robust compression fit around the connector. In one arrangement, each loop section 34-1, 34-2 has, as the bend radius 36-1, 36-2, a minimum bend radius (e.g., each loop section 34-1, 34-2 defines a 0.060 inch gap).

Furthermore, as further shown in FIGS. 1 and 2B, the central portion 22 of the clip 20 is substantially C-shaped. In particular, the middle section of the central portion 22 extends in a direction that is up and away from the arm portions 24-1, 24-2. As a result and as will be discussed in further detail later, the central portion 22 can avoid interfering with components of the module (e.g., physically hitting a component, electrically shorting a module contact, etc.). Moreover, the C-shape feature of the clip 20 makes the clip 20 easier to handle (e.g., more ergonomically and/or cosmetically attractive) during installation and removal.

In one arrangement, the central portion 22 and arm portions 24-1, 24-2 are formed as a single (i.e., unitary) member of rigid, resilient material such as sheet metal (e.g., a wire form clip), plastic, and the like. In one arrangement, the thickness of the portions 22, 24-1, 24-2 is substantially uniform (e.g., substantially 0.040 inches in diameter). Accordingly, these arrangements of the clip 20 are well suited for simple and straight-forward manufacturing processes such as cutting and bending sheet metal or wire, extruding plastic polymer material, etc. Further details of the invention will now be provided with reference to FIGS. 3 through 6 which show portions of a circuit board assembly in various stages of assembly.

Figure 3:
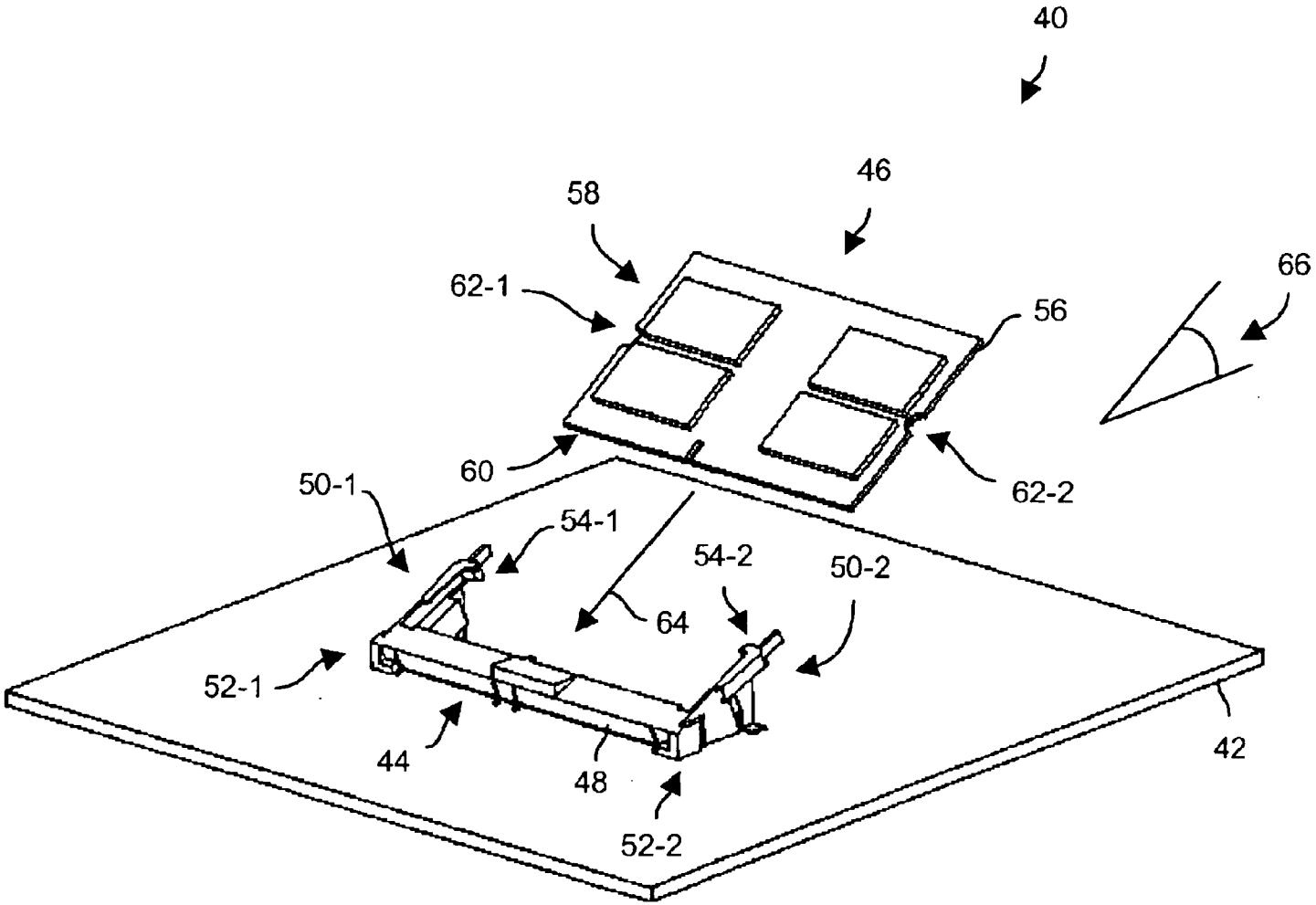
FIG. 3 is a perspective view of portions of a circuit board assembly which is suitable for use by the invention.

FIG. 3 shows portions of a circuit board assembly 40 which are suitable for use by the invention. The circuit board assembly 40 includes a circuit board 42 (e.g., a section of circuit board material populated by circuit board components mounted thereon), a module connector 44 mounted to the circuit board 42, and a module 46.

As shown in FIG. 3, the module connector 44 includes a connector base 48 which is in electrical communication with conductive material of the circuit board 42. In one arrangement, the connector base 48 is fastened to the circuit board 42 using hardware (e.g., bolted, screwed, etc.). In another arrangement, the connector base 48 is attached by other means (e.g., soldered, glued, etc.). The module connector 44 further includes a first connector lever 50-1 and a second connector lever 50-2. The first connector lever 50-1 attaches to the connector base 48 at a first hinge 52-1, and is configured to pivot relative to the connector base 48 about the hinge 52-1. Similarly, the second connector lever 50-2 attaches to the connector base 48 at a second hinge 52-2, and is configured to pivot relative to the connector base 48 about the hinge 52-2. Each connector lever 52-1, 52-2 defines a respective tab 54-1, 54-2.

As further shown in FIG. 3 and by way of example only, the module 46 includes a section of circuit board material 56 (e.g., layers of conductive and non-conductive material sandwiched together) and a set of circuit board components 58 (e.g., ICs) mounted to the circuit board section 56. The circuit board section 56 has a connecting edge 60 (e.g., an array of contacts distributed along a periphery of the circuit board section 56), and sides defining notches (or grooves) 62-1, 62-2 which extend toward each other due to their orientation on opposing parallel sides of the circuit board section The module 46 is configured to connect with the connector base 48 of the module connector 44 when the connecting levers 50-1, 50-2 are spread apart and when the module moves in a direction 64 as shown in FIG. 3. In particular, metallic contacts of the circuit board section 56 along the connecting edge 60 of the module 46 are configured to electrically couple with corresponding connector contacts within the connector base 48 when the module moves in the direction 64 (e.g., in response to handling by a user). For illustration purposes only, the module connector 44 receives the module 46 at an angle 66 (e.g., at a 30 degree angle).

Figure 4:
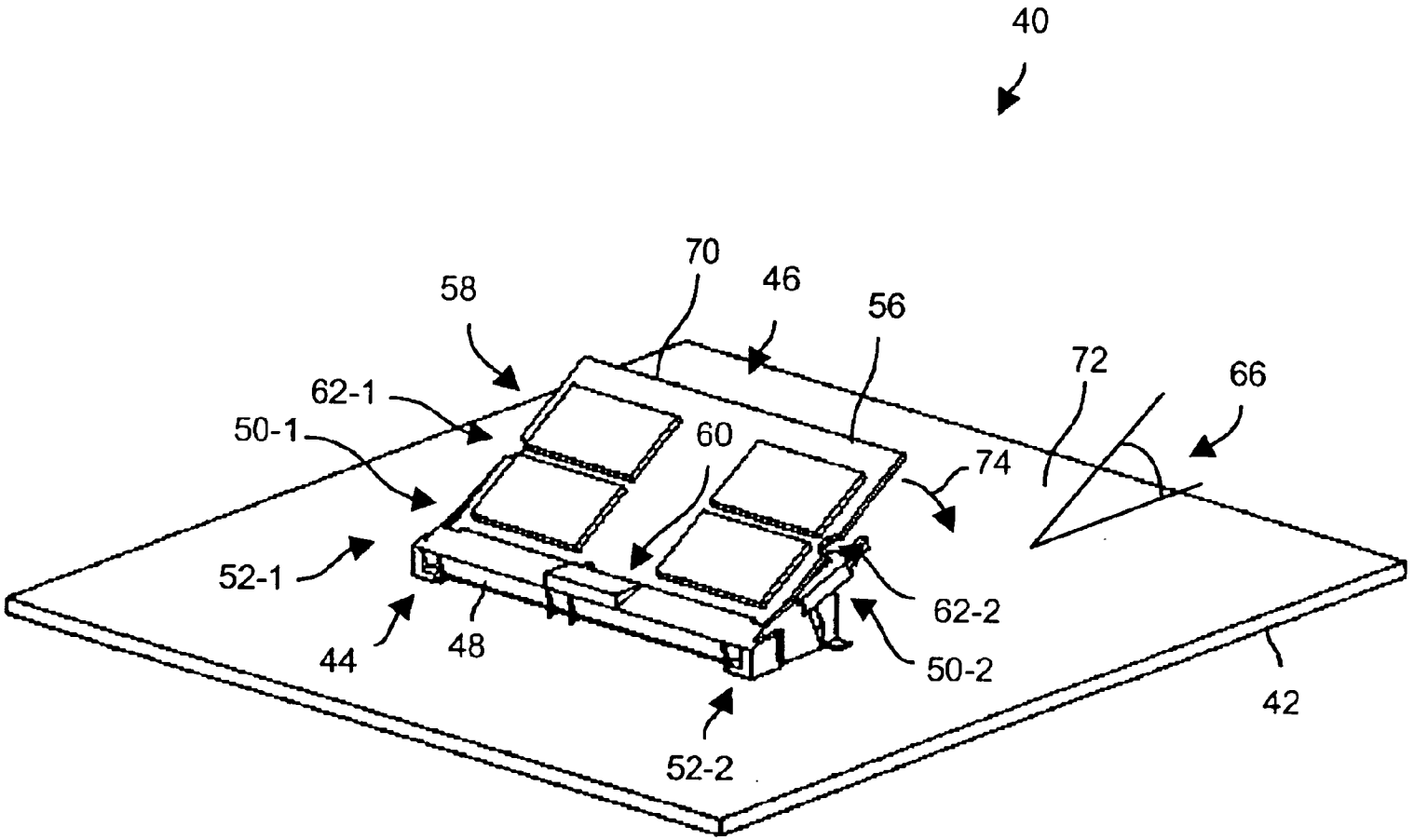
FIG. 4 is a perspective view of the portions of the circuit board assembly in a partially installed state.

FIG. 4 shows portions of the circuit board assembly 40 when the module 46 is partially installed with the module connector 44. In particular, the connecting edge 60 of the module 46 resides within the connector base 48. At this point, the module connector 44 and the module 46 are configured to provide angular movement between the planes of the circuit board 42 and the module 46. That is, the distal edge 70 of the module 46 is capable of arching toward the surface 72 of the circuit board 42 in a direction 74 while the connecting edge 60 of the module 46 remains within the connector base 48 of the module connector 44. In one arrangement, the module 46 pivots about the connector base 48 from the initial angle 66 to a smaller angle (e.g., 22.5 degrees).

Furthermore, the connector levers 50-1, 50-2 of the module connector 44, which are still spread apart in FIG. 4, are configured to move toward the module 46. In particular, the tabs 54-1, 54-2 defined by the connector levers 50-1, 50-2 (FIG. 3) are configured to respectively engage the notches 62-1, 62-2 along the sides of the circuit board section 56 of the module 46.

Figure 5:
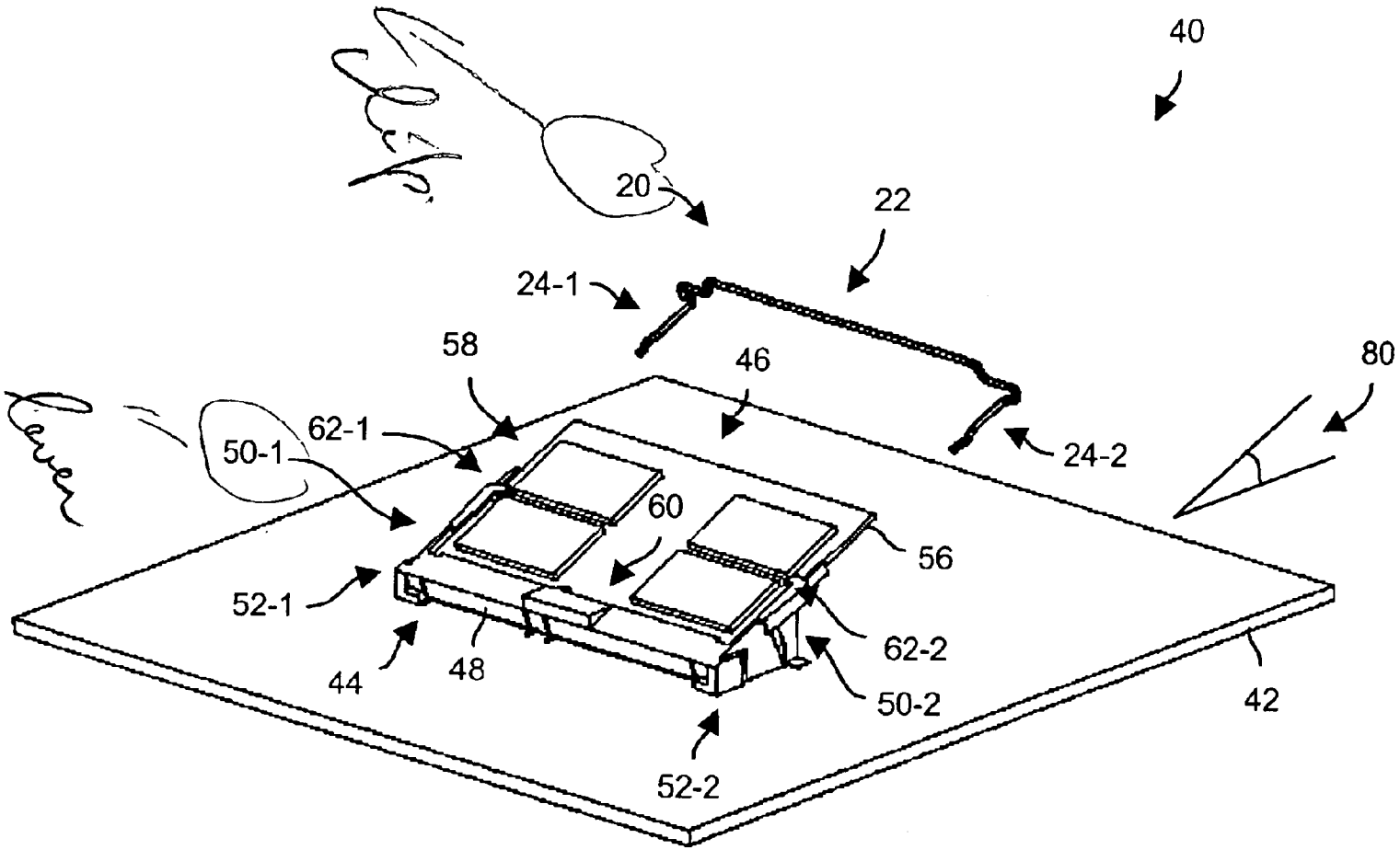
FIG. 5 is a perspective view of the portion of the circuit board assembly in another partially installed state and with the clip of FIG. 1.

FIG. 5 shows portions of the circuit board assembly 40 with the module 46 pivoted toward the circuit board 42 to a smaller angle 80 (e.g., 22.5 degrees) and with the connector levers 50-1, 50-2 closed (or latched) against the sides of the module 46. In one arrangement, each connector lever 50-1, 50-2 is configured to partially fit over a portion of a side of the module 46 to retain the module 46 at the smaller angle 80 within the module connector 44 (e.g., each lever 50-1, 50-2 has a U-shaped or L-shaped cross-section so that a lip of the lever 50-1, 50-2 interferes with the module 46 if a force attempts to pivot the module 46 back toward the initial angle 66).

At this point, the tabs 54-1, 54-2 defined by the connector levers 50-1, 50-2 respectively engage the notches 62-1, 62-2 along the sides of the circuit board section 56 of the module 46 (also see FIGS. 3 and 4 for comparison). Here, the module 46 is in electrical communication with the connector base 48 of the module connector 44, and thus in electrical communication with other circuitry on the circuit board 42. Additionally, the circuit board assembly 40 may be able to withstand particular vibrations without becoming disconnected (e.g., the assembly 40 may even be able to withstand a comprehensive vibration test). However, it may be possible to jostle the module 46 from the connector 44 with a particular shock or vibration such as those encountered during shipping by a conventional courier or shipping service.

As further shown in FIG. 5, the clip 20 of FIGS. 1, 2A and 2B is configured for installation over the module connector 44. In particular, the arm portions 24-1, 24-2 of the clip 20 are oriented such that they extend toward and along the connector levers 50-1, 50-2, and the portions 22, 24-1, 24-2 are oriented such that they are substantially parallel to the plane of the module 46. At this point, the clip 20 is prepared to slide over the connector levers 50-1, 50-2 to further improve the ability of the circuit board assembly 40 to withstand shock and vibration.

Figure 6:
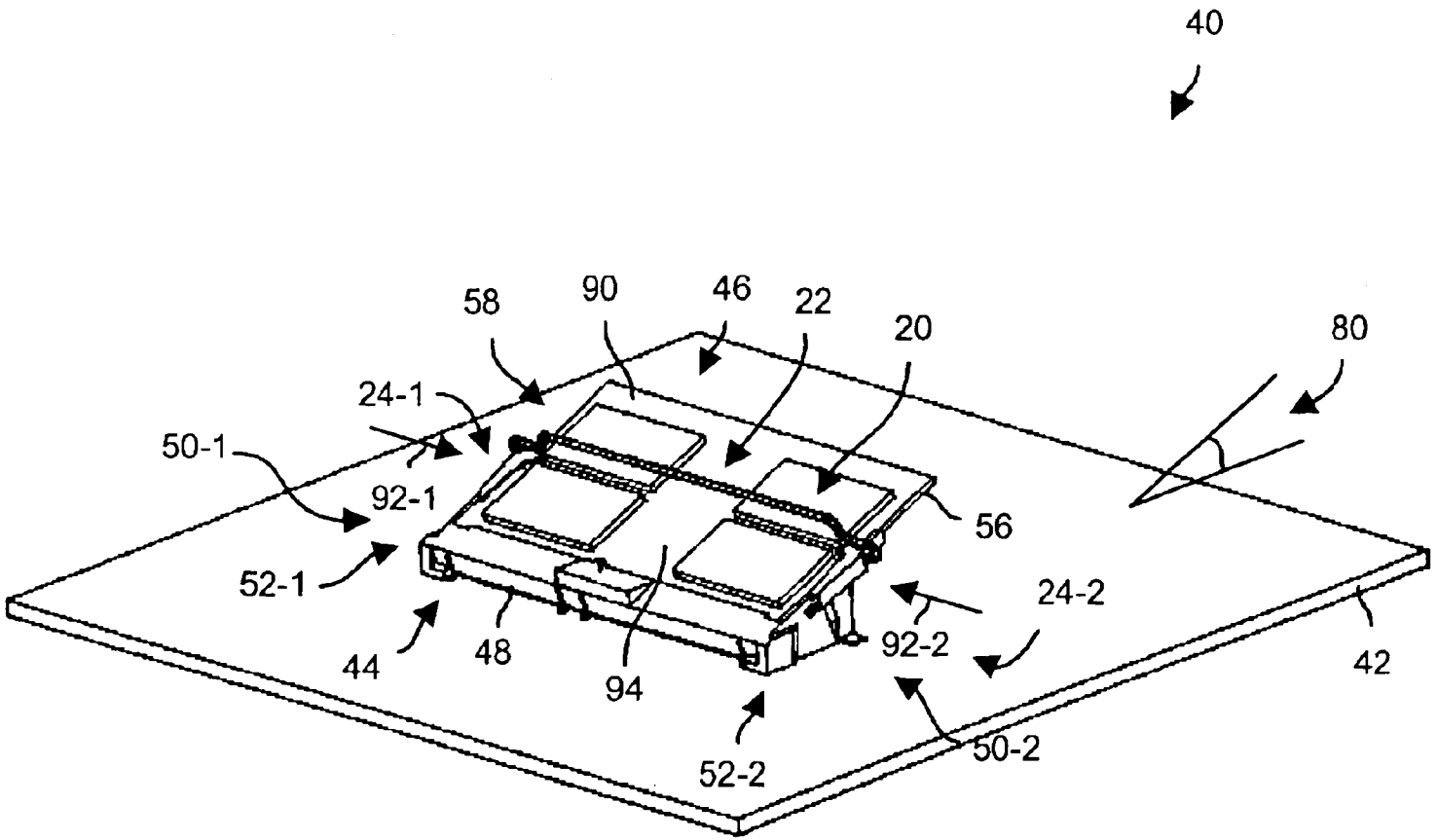
FIG. 6 is a perspective view of the circuit board assembly in a fully installed state.

FIG. 6 shows the circuit board assembly 40 with the clip 20 installed over the module connector 44 to hold the module 46 to the module connector 44 and thus prevent the module 46 from becoming electrically disconnected from the circuit board 42. Here, the central portion 22 of the clip 20 extends in a substantially parallel manner over a surface 90 of the module 46. Additionally, the arm portion 24-1 provides a force 92-1 on the connector lever 50-1 that pushes the connector lever 50-1 against the side of the module 46 and toward a central region 94 of the module 46. Similarly, the arm portion 24-2 provides a force 92-2 on the connector lever 50-2 that pushes the connector lever 50-2 against the side of the module 46 and toward a central region 94 of the module 46 (the force 92-2 being in a direction that is substantially opposite that of the force 92-1). In particular, the forces 92-1, 92-2 provided by the arm portions 24-1, 24-2 urge the tabs 54-1, 54-2 defined by the connector levers 50-1, 50-2 tightly into the notches 62-1, 62-2 on the sides of the circuit board section 56 of the module 46 (FIG. 3) thus robustly retaining the module 46 within the connector 44.

It should be understood that the clip 20 is preferably at least partially formed of material (e.g., sheet metal, plastic, etc.) that provides both resiliency and rigidness to continuously push the connecting levers 50-1, 50-2 toward each other and to continuously hold the connecting levers 50-1, 50-2 in place. The forces 92-1, 92-2, which are in opposite directions and aimed toward the central region 94 of the module 46, are at least in part due to spring action of the clip 20 resulting from the portion 22, 24-1, 24-2 being formed as a unitary member from such material. Such spring action facilitates holding the clip 20 in place when installed over the connector 44 (i.e., compresses the clip 20 onto the connector 44 to prevent the clip 20 from falling off or sliding out of its installed position), as well as enables easy installation and removal.

For example, a user can install the clip 20 simply by moving the clip 20 from its initial location (see FIG. 5) to its installed location (see FIG. 6) without exerting an uncomfortable amount of manual effort and without applying extreme forces that could perhaps damage the circuit board assembly 40. As another example, the user can remove the clip 20 simply by moving the clip 20 from its installed location (FIG. 6) to its initial location (FIG. 5) in a similar manner. In both instances, the user simply provides enough force to overcome the frictional forces of the clip 20 against the connector 44.

It should be understood that the amount of compression (see forces 92-1, 92-2 in FIG. 6) provided by the clip 20 is controllable in a variety of ways. For example, the forces 92-1, 92-2 can be controlled through control of the material used to form the portions 22, 24-1, 24-2 of the clip 20, by controlling the distance D between the arm portions 24-1, 24-2 (FIG. 2A), by changing the shape and locations of contact points (e.g., see subtle bends at the ends of the arm portions 24-1, 24-2 in FIG. 2A), among others ways.

As mentioned earlier in connection with FIGS. 1, 2A and 2B, the arm portions 24-1, 24-2 respectively define loop sections 34-1, 34-2. It should be understood that the bend radius 36-1, 36-2 of each loop section 34-1, 34-2 (see FIG. 2B) respectively conforms to connector levers 50-1, 50-2 of the connector 44 (see FIG. 6). As a result of this configuration in combination with the above-mentioned spring action provided by the clip 20, the arm portions 24-1, 24-2 are configured to fit snuggly around the connector levers 50-1, 50-2 for a robust compression fit around the connector 44 and the module 46.

As further mentioned above in connection with FIGS. 1 and 2B, the central portion 22 of the clip 20 is substantially C-shaped. That is, from the arm portions 24-1, 24-2, the central portion 22 extends up and away from the arm portions 24-1, 24-2. Accordingly, the central portion 22 avoids interfering with components of the module 46 (e.g., the central portion does not contact the components 58 of the module 46, see FIG. 6). Furthermore, the C-shape of the clip 20 enables a user to easily handle the clip 20 during installation and removal (e.g., the user can easily grab the clip 20 without touching the components 58 of the module 46, also see FIG. 6). Further details of the invention will now be provided with reference to FIG. 7.

Figure 7:
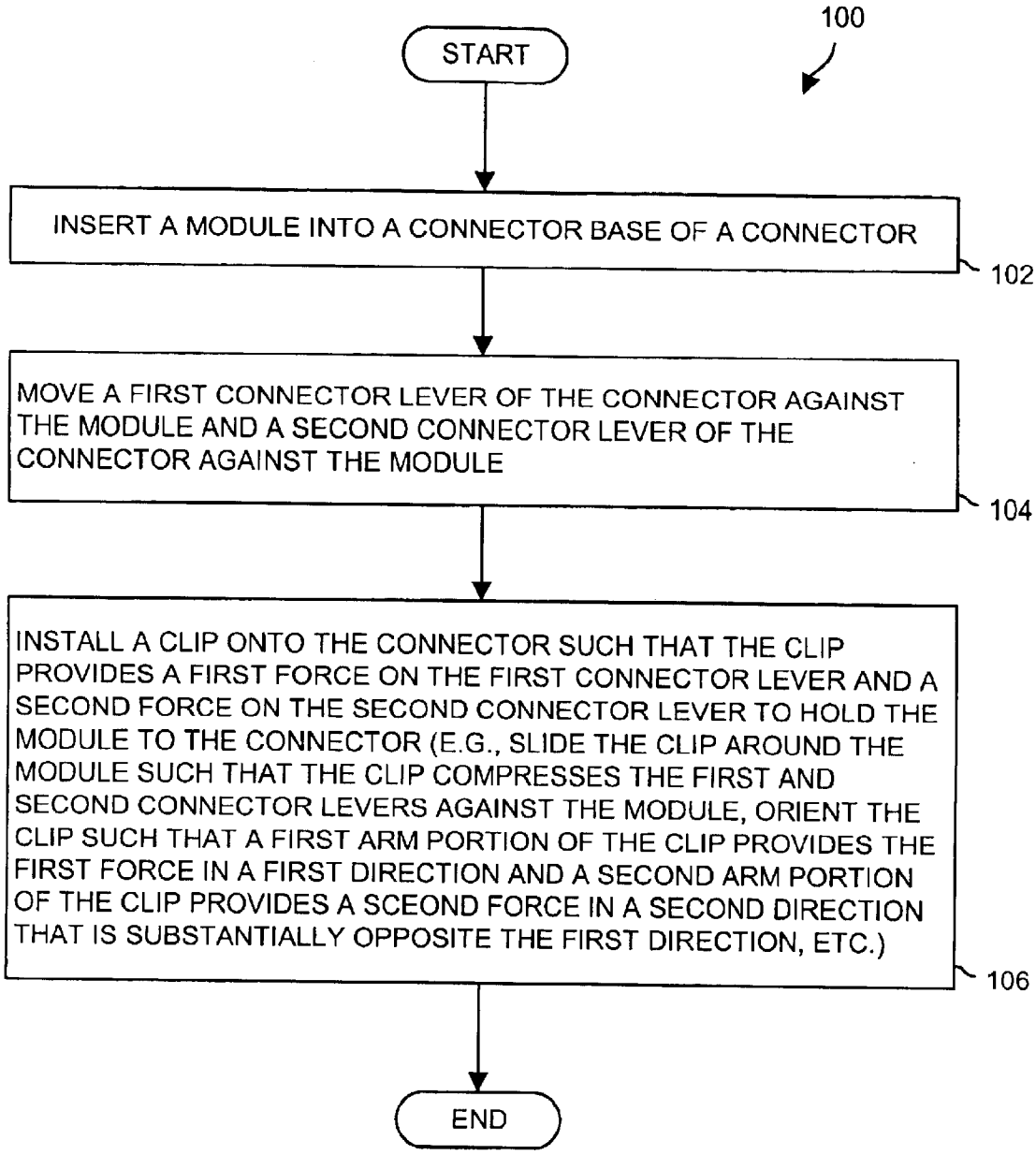
FIG. 7 is a flowchart of a procedure which is performed by a user when installing the portions of the circuit board assembly.

FIG. 7 is a flowchart of a procedure 100 which is performed by a user when installing the portions 42, 46, 20 of the circuit board assembly 40. In step 102, the user inserts the module 46 into the connector base 48 of the connector 44 (also see FIGS. 3 and 4). In particular, the user engages the connecting edge 60 of the module 46 with the connector base 48 to align module contacts along the connecting edge 60 with corresponding connector contacts within the connector base 48. For some module connectors 44, the user inserts the module 46 into the connector 44 at an initial angle 66 (FIG. 4), and then pivots or rotates the module 46 to a new angle 80 (FIG. 5).

In step 104, the user moves the connector levers 50-1, 50-2 against the module 46. In particular, the user pushes the connector lever 50-1 such that a tab 52-1 defined by the connector lever 50-1 inserts into a corresponding notch 62-1 of the circuit board section 56 of the module 46 (also see FIGS. 3 through 5) thus latching the lever 50-1 against the module 46. Similarly, the user pushes the connector lever 50-2 such that a tab 52-2 defined by the connector lever 50-2 inserts into a corresponding notch 62-2 of the circuit board section 56. At this point, the module connector 44 connects with the module 46.

In step 106, the user installs the clip 20 onto the module connector 44 such that the clip 20 provides a first force 92-1 on the connector lever 50-1 and a second force 92-1 on the second connector lever 92-2 to hold the module 46 to the module connector 44. In particular, the user slides the clip 20 onto the connector 44 by moving the clip 20 from an initial location and orientation (see FIG. 5) to anew location and orientation (see FIG. 6). At this point, the clip 20 compresses the connector levers 50-1, 50-2 toward each other thus robustly retaining the module 46 within the connector 44. Accordingly, the module 46 is less likely to disconnect from the connector 44 in response to vibration (e.g., shakes, shocks, jostles and other movements normally encountered by a device containing the circuit board assembly 40 during shipping).

As mentioned above, the invention is directed to techniques for connecting a module 46 to a module connector 44 utilizing a clip 20 that facilitates retention of the module 46 within the connector 44. The clip 20 is configured to install onto the connector 44 and to provide forces 92-1, 92-2 against levers 50-1, 50-2 of the connector 44 to retain the module 46 within the connector 44, i.e., to prevent the module 46 from disconnecting from the connector 44. The use of such a clip 20 on a device to retain a module 46 within a connector 44 of the device decreases the likelihood of a device failure (e.g., preventing disconnection of the module 46 from the connector 44 during shipping) thereby promoting a reputation of reliability and enhancing customer goodwill. Such techniques are well suited for circuit board assemblies within particular types of devices having the above-described configuration, e.g., for retaining memory linecards (modules 46) within the connectors of motherboards (circuit boards 42) of data communications devices.

While this invention has been particularly shown and described with references to preferred embodiments thereof, it will be understood by those skilled in the art that various changes in form and details may be made therein without departing from the spirit and scope of the invention as defined by the appended claims.

For example, it should be understood that the clip 20 was described above as being formed by sheet metal, wire or plastic by way of example only. Other materials are suitable for use as well, and combinations of materials are also suitable. For example, in one arrangement, an interior core of the clip 20 is formed by metal to provide rigidness and resiliency, and an outer softer, non-conductive coating of the clip 20 (e.g., a vinyl-bond coating of 0.005 inch thickness, a rubber sleeve, etc.) provides a more ergonomic feel for the user as well as prevents the clip 20 from inadvertently causing a short if the clip 20 makes contact with one or more electronic components. In some arrangements, the coating does not completely cover the clip 20 (e.g., only covers a portion of the clip such as part of the central portion 22, see darken areas of the central portion 22 in FIG. 2B).

Additionally, it should be understood that the clip 20 was described above as being installed by a user by way of example only. In other arrangements, the clip 20 is installed by other means, e.g., by automated equipment.

Furthermore, it should be understood that the central portion 22 of the clip 20 was described above as being C-shaped by way of example only in order to make the clip 20 easier to handle and so that the clip 20 was less likely to interfere with the components 58 of the module 46. Other shapes are suitable for use as well. For example, in some arrangements, the central portion 22 of the clip 20 has a different shape (e.g., an overall M-shape, a relatively flat cross-section, etc.) to improve the users ability to handle (e.g., grab and move) the clip 20.

Additionally, it should be understood that the clip 20 was described above as being well suited to hold a module 46 within a module connector 44. It should be understood that the clip 20 is also well suited for holding other things to a connector. For example, the clip 20 is well suited for other types of devices to the connector 44 (e.g., other connectors, cable ends, components, etc.).

Furthermore, it should be understood that additional features can be added to the clip 20 to improve its performance. For example, bends, welds and other strengthening enhancements can be incorporated within the clip 20 to enable the clip 20 to provide additional force if necessary, and/or to enable the clip 20 to withstand counter forces and fatigue.

What is claimed is:

1. A method for connecting a module to a connector, the method comprising the steps of:

inserting the module into a connector base of the connector;

moving a first connector lever of the connector against the module and a second connector lever of the connector against the module, the module being a circuit board and the step of moving including engaging tabs into notches within sides of the circuit board; and installing a clip onto the connector such that the clip provides a first force on the first connector lever and a second force on the second connector lever to hold the module to the connector.

2. The method of claim 1 wherein the step of installing the clip includes the step of:

sliding the clip around the module such that the clip compresses the first and second connector levers against the module.

3. The method of claim 1 wherein the step of installing the clip includes the step of:

orienting the clip such that a first arm portion of the clip provides the first force in a first direction and a second arm portion of the clip provides a second force in a second direction that is substantially opposite the first direction.

4. A circuit board assembly, comprising:

a motherboard;

a connector mounted to the motherboard, the connector having (i) a connector base, (ii) a first connector lever coupled to the connector base, and (iii) a second connector lever coupled to the connector base;

a module which is configured to connect with the connector base of the connector; and a clip which is configured to hold the module to the connector mounted to the motherboard, wherein the dip includes a central portion, a first arm portion coupled to the central portion, and a second arm portion coupled to the central portion, and wherein the first and second arm portions are disposed relative to the central portion such that, when the module connects with the connector base of the connector and when the clip is installed onto the connector, (i) the central portion of the clip extends in a substantially parallel manner over a surface of the module, (ii) the first arm portion of the clip provides a first force on the first connector lever, and (iii) the second arm portion of the clip provides a second force on the second connector lever to hold the module to the connector.

5. The circuit board assembly of claim 4 wherein the module includes a circuit board and memory devices mounted to the circuit board; wherein the circuit board defines a first notch and a second notch; and wherein the clip is configured such that, when the module connects with the connector base of the connector and when the clip is installed onto the connector, the first force provided by the first arm portion of the clip pushes a portion of the first connector lever into the first notch defined by the circuit board, and the second force provided by the second arm portion of the clip pushes a portion of the second connector lever into the second notch defined by the circuit board.

6. The circuit board assembly of claim 4 wherein the central portion of the clip separates the first arm portion and the second arm portion by a distance that enables the clip to slide around the module and compress the first and second connector levers against the module when the module connects with the connector base of the connector and when the clip is installed onto the connector.

7. The circuit board assembly of claim 4 wherein the first arm portion of the clip is configured to provide the first force against the first connector lever and toward a central region of the module, and wherein the second arm portion of the clip is configured to provide the second force against the second connector lever and toward the central region of the module, when the module connects with the connector base of the connector and when the dip is installed onto the connector.

8. The circuit board assembly of claim 4 wherein the first arm portion of the clip is configured to provide the first force in a first direction and the second arm portion of the clip is configured to provide the second force in a second direction that is substantially opposite the first direction when the module connects with the connector base of the connector and when the clip is installed onto the connector.

9. The circuit board assembly of claim 4 wherein the central portion of the clip extends substantially in a central portion direction, wherein the first arm portion extends substantially in a first arm portion direction that is substantially perpendicular to the central portion direction, and wherein the second arm portion extends substantially in a second arm portion direction that is substantially perpendicular to the central portion direction.

10. The circuit board assembly of claim 4 wherein the first arm portion of the clip defines a first loop section having a bend radius that conforms to the first connector lever, and wherein the second arm portion of the clip defines a second loop section having a bend radius that conforms to the second connector lever.

11. The circuit board assembly of claim 4 wherein the central portion of the clip is substantially C-shaped.

12. A clip for holding a module to a connector, the connector having (i) a connector base, (ii) a first connector lever coupled to the connector base, and (iii) a second connector lever coupled to the connector base, the clip comprising:

a central portion;

a first arm portion coupled to the central portion; and a second arm portion coupled to the central portion, wherein the first and second arm portions are disposed relative to the central portion such that, when the module connects with the connector base of the connector and when the clip is installed onto the connector, (i) the central portion of the clip extends in a substantially parallel manner over a surface of the module, (ii) the first arm portion of the clip provides a first force on the first connector lever, and (iii) the second arm portion of the clip provides a second force on the second connector lever to hold the module to the connector.

13. The clip of claim 12 wherein the module includes a circuit board and memory devices mounted to the circuit board; wherein the circuit board defines a first notch and a second notch; and wherein the clip is configured such that, when the module connects with the connector base of the connector and when the clip is installed onto the connector, the first force provided by the first arm portion of the clip pushes a portion of the first connector lever into the first notch defined by the circuit board, and the second force provided by the second arm portion of the clip pushes a portion of the second connector lever into the second notch defined by the circuit board.

14. The clip of claim 12 wherein the central portion of the clip separates the first arm portion and the second arm portion by a distance that enables the clip to slide around the module and compress the first and second connector levers against the module when the module connects with the connector base of the connector and when the clip is installed onto the connector.

15. The clip of claim 12 wherein the first arm portion of the clip is configured to provide the first force against the first connector lever and toward a central region of the module, and wherein the second arm portion of the clip is configured to provide the second force against the second connector lever and toward the central region of the module, when the module connects with the connector base of the connector and when the clip is installed onto the connector.

16. The clip of claim 12 wherein the first arm portion of the clip is configured to provide the first force in a first direction and the second arm portion of the clip is configured to provide the second force in a second direction that is substantially opposite the first direction when the module connects with the connector base of the connector and when the clip is installed onto the connector.

17. The clip of claim 12 wherein the central portion of the clip extends substantially in a central portion direction, wherein the first arm portion extends substantially in a first arm portion direction that is substantially perpendicular to the central portion direction, and wherein the second arm portion extends substantially in a second arm portion direction that is substantially perpendicular to the central portion direction.

18. The clip of claim 12 wherein the first arm portion of the clip defines a first loop section having a bend radius that conforms to the first connector lever, and wherein the second arm portion of the clip defines a second loop section having a bend radius that conforms to the second connector lever.

19. The clip of claim 12 wherein the central portion of the clip is substantially C-shaped.

20. A clip for holding a module to a connector, the connector having (i) a connector base, (ii) a first connector lever coupled to the connector base, and (iii) a second connector lever coupled to the connector base, the clip comprising:

a central portion; and means, coupled to the central portion, for providing a first force on the first connector lever and a second force on the second connector lever to hold the module to the connector when the module connects with the connector base of the connector and when the clip is installed onto the connector, wherein notches reside along sides of the module, and wherein the means for providing is configured to apply force against the first and second connector levers to compress the first and second connector levers toward each other and into the notches.

21. The method of claim 1 wherein the step of moving includes the step of:

pushing the first connector lever and the second connector lever toward each other.

22. The method of claim 1 wherein the step of installing the clip includes the step of:

applying the clip around the first connector lever and the second connector lever to push the first connector lever and the second connector lever toward each other.

23. The clip of claim 20 wherein the mean for providing includes:

means for pushing the first connector lever and the second connector lever toward each other.

* * * * *

UNITED STATES PATENT AND TRADEMARK OFFICE

CERTIFICATE OF CORRECTION

PATENT NO. : 6,830,464 B1
DATED : December 14, 2004
INVENTOR(S) : Steven Darren Friend It is certified that error appears in the above-identified patent and that said Letters Patent is hereby corrected as shown below:

Column 9,
Lines 8 and 48, "the dip" should read -- the clip --

Signed and Sealed this

Thirty-first Day of May, 2005

JON W. DUDAS
*Director of the United States Patent and Trademark Office*